US005846404A

United States Patent [19]

Fong et al.

[11] Patent Number: 5,846,404

[45] Date of Patent: Dec. 8, 1998

[54] PROCESS FOR THE REMOVAL OF SELENIUM FROM SELENIUM-CONTAINING AQUEOUS STREAMS

[75] Inventors: Raymond Tom Fong, Benicia, Calif.; John Bernard Rodden, Houston, Tex.; Jack Thomas Veal, Sugar Land, Tex.; Charles Lee Meyer; Michael Norris Treybig, both of Houston, Tex.; Coley Jerald Williams, Kingwood, Tex.; Richard Joseph Horvath, Spring, Tex.

[73] Assignee: Shell Oil Company, Houston, Tex.

[21] Appl. No.: 306,858

[22] Filed: Sep. 15, 1994

Related U.S. Application Data

[63] Continuation of Ser. No. 155,667, Nov. 22, 1993, abandoned, which is a continuation-in-part of Ser. No. 81,734, Jun. 23, 1993, abandoned.

[51] Int. Cl.[6] ..... C10G 9/14

[52] U.S. Cl. ..... 208/131; 208/48 Q; 208/370; 423/508; 423/509; 210/633; 210/719; 210/688

[58] Field of Search ..... 208/131, 48 Q, 208/13, 127, 130; 423/445, 460, 508, 509; 210/633, 719, 688

[56] References Cited

U.S. PATENT DOCUMENTS

| | | | |
|---|---|---|---|
| 2,773,003 | 12/1956 | Brown et al. | 208/370 |
| 3,853,744 | 12/1974 | Lahn | 208/127 |
| 4,405,464 | 9/1983 | Baldwin et al. | 210/717 |
| 4,806,264 | 2/1989 | Murphy | 210/695 |
| 4,915,928 | 4/1990 | Marcantonio | 423/510 |
| 4,935,146 | 6/1990 | O'Neill et al. | 210/684 |
| 4,968,407 | 11/1990 | McGrath et al. | 208/131 |
| 5,082,570 | 1/1992 | Higgins et al. | 210/683 |
| 5,198,103 | 3/1993 | Meyer et al. | 208/431 |
| 5,258,115 | 11/1993 | Heck et al. | 208/13 |
| 5,376,262 | 12/1994 | Perry | 210/651 |

FOREIGN PATENT DOCUMENTS 7330558 9/1973 Japan .

SU833-571 5/1981 Russian Federation .

OTHER PUBLICATIONS

James W. Patterson, "Selenium," *Industrial Waste Water Treatment Technology, Second Edition,* Ch. 21, pp. 395–403 (1985) (No month).

D. T. Merrill et al., "Field Evaluation of Arsenic and Selnium [sic] Removal by Iron Coprecipitation," *Journal WPCF, vol. 58, No. 1,* pp. 18–26 (Jan. 1986).

R.R. Trussell et al., *Selenium Removal from Groundwater Using Activated Alimina,* EPA–600/2–80–153, US EPA, Cincinnati, Aug. 1980.

J.V. Boegel and D. A. Clifford, *Selenium Oxidation and Removal by Ion Exchange.* PB 86–171 428 AS, NTIS, Springfield, Virginia, Mar. 1986.

Richard W. Harris, "Using Reclaimed Water to Quench Your Coke," *Water Environment Federation 65th Annual Conference & Exposition,* pp. 225–236 Sep. (1992).

(List continued on next page.)

*Primary Examiner*—Glenn A. Oaldarola
*Assistant Examiner*—Walter D. Griffin
*Attorney, Agent, or Firm*—Y. Grace Tsang; Donna K. Blalock

[57] ABSTRACT

A selenium-containing aqueous stream may be used as a quenching water stream and optionally a cutting water stream in a delayed coking process to effectuate the removal of selenium from the selenium-containing aqueous stream resulting in the formation of a selenium-coke product. In addition, selenium may be concentrated in selenium-containing stripped sour water streams by recycling the stream in one or more hydroprocessing units and one or more sour water stripper units and subsequently removed by using a portion of the selenium-containing stripped sour water stream as a quenching water stream and optionally a cutting water stream in a delayed coking process.

24 Claims, 1 Drawing Sheet

OTHER PUBLICATIONS

*Water Quality and Treatment: A Handbook of Community Water Supplies,* p.624 (No date).

*Metals and Their Compounds in the Environment,* Edited by Ernest Merian, ISBN 3–527–26521–X, 2nd. Rev. Ed. Mar. 1991. (VCH, New York).

*Chemical Process for Removing Selenium from Water,* PB91–155382, Nov. 9, 1990, U.S. Dept. of the Interior, Washington, D.C., U.S. Dept. of Commerice, NTIS.

Thomas J. Sorg and Gary S. Logsdon, *Removal of Selenium From Water –State of the Art,* EPA, Cincinnati, Ohio pp. 114–128 (No date).

TH-0136
FIG. 1
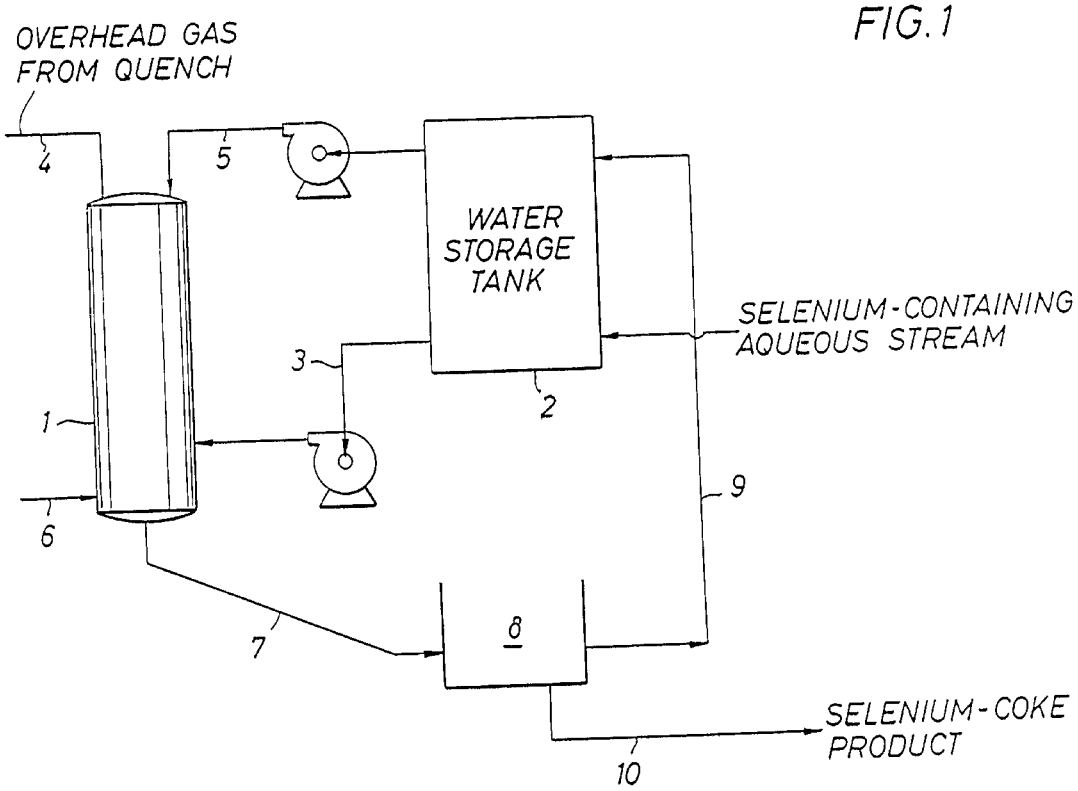
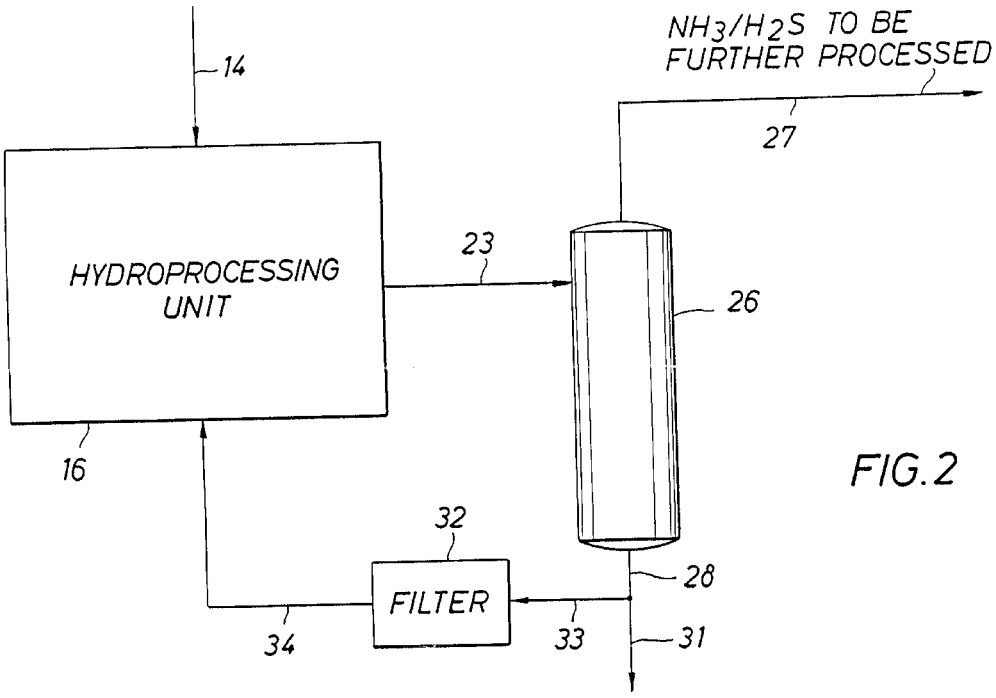
FIG. 2

PROCESS FOR THE REMOVAL OF SELENIUM FROM SELENIUM-CONTAINING AQUEOUS STREAMS

This is a continuation of application Ser. No. 08/155,667, filed Nov. 22, 1993, now abandoned, which is a continuation-in-part of application Ser. No. 08/081,734, filed Jun. 23, 1993, now abandoned.

FIELD OF THE INVENTION

The present invention relates to a process for removing selenium from selenium-containing aqueous streams utilizing a delayed coking process. The present invention further relates to a process for concentrating selenium in stripped sour water streams. The present invention still further relates to a process for concentrating selenium in stripped sour water streams obtained from one or more hydroprocessing units and one or more sour water stripper units by recycling such streams and removing the concentrated selenium contained in the stripped sour water streams utilizing a delayed coking process.

DESCRIPTION OF THE PRIOR ART

Selenium is a naturally occurring group VIA element found throughout the environment in varying concentrations with the average concentration in the earth's crust being about 0.7 ppm. Selenium is present in varying amounts throughout the United States with higher concentrations generally found in the western states. In areas with higher concentrations, selenium is often found in detectable levels in items such as plants, crops and crude oils.

While small amounts of selenium have been shown to be necessary to sustain life, high concentrations are potentially harmful to humans, animals and agriculture. Because of this potential harm, environmental standards exist which place restrictions on the disposal of materials which contain selenium.

Waste water streams which are produced during the refining of crude oils and which are often reintroduced into the environment after conventional treatment to reduce contaminants may be governed by these standards. The amount of selenium present in the crude oils produced from many areas is negligible. In other areas, such as the western states of the United States, selenium levels are higher and the waste water streams produced during refining must be closely monitored to insure that the levels of selenium being reintroduced into the environment do not violate current applicable environmental standards. Impending changes in environmental standards in some areas have created a need for new, more efficient methods for removing selenium from refinery waste water streams, as well as other process waste water streams, prior to reintroducing the streams into the environment.

Currently, only a limited number of processes for removing selenium from waste water streams are available. Such processes include reverse osmosis techniques and various adsorption techniques such as iron and aluminum hydroxide adsorption/coprecipitation. These processes have a number of disadvantages including that they are costly and difficult to implement because they produce additional waste streams of a substantial volume, relative to the amount of selenium removed. Additional steps other than those necessary for refining must be taken to treat or dispose of the waste water streams thus produced.

It has now been found that selenium can be effectively concentrated in stripped sour water streams during certain refinery processes thereby producing smaller amounts of aqueous media which require treatment for the removal of selenium. It has also now been found that selenium can be effectively removed from selenium-containing aqueous streams, including concentrated selenium in stripped sour water streams, during certain refinery processes thereby eliminating the need for additional treatment of the aqueous streams to remove selenium prior to reintroducing the streams into the environment.

SUMMARY OF THE INVENTION

The present invention relates to a process in which a selenium-containing aqueous stream is used as a quenching water stream in a delayed coking process to effectuate the removal of the selenium from the selenium-containing aqueous stream. The present invention further relates to a process for concentrating selenium in stripped sour water streams prior to removing the selenium. The present invention even further relates to a process in which concentrated selenium is removed from a selenium-containing stripped sour water stream generated in one or more hydroprocessing units and one or more sour water stripper units by using a portion of the selenium-containing stripped sour water stream as a quenching water stream and optionally a cutting water stream in a delayed coking process.

DESCRIPTION OF THE FIGURES

FIG. 1 represents an illustration of the routing of a selenium-containing aqueous stream to a delayed coker unit for use as a quenching water stream whereby selenium removal is effectuated and also as a cutting water stream for removing selenium-coke product.

FIG. 2 represents an illustration of the routing of selenium-containing sour water through a hydroprocessing unit and a sour water stripper unit, resulting in a concentrated selenium-containing stripped sour water stream which may be used as a quenching water stream and/or cutting water stream in a delayed coking process.

DESCRIPTION OF THE PREFERRED EMBODIMENTS

In the present invention, selenium is effectively removed from selenium-containing aqueous streams utilizing the equipment employed in a conventional delayed coking process. As used herein, the term "selenium" refers to all forms of selenium, including selenium compounds and elemental selenium. In a conventional delayed coking process, a fresh feed source, such as atmospheric residuum or pitch, is directed to the bottom of a coker product fractionator where it combines with a recycle stream from the fractionator. The combined feed and recycle stream leave the bottom of the coker product fractionator and are fed into a coker furnace where the temperature of the feedstock is raised to a level appropriate for forming coke, i.e., about 900° F. (482° C.) and above. The heated coke feedstock is then routed from the coker furnace to a coke drum where conditions are maintained such that the thermal cracking and coking reactions occur. Volatile cracked molecules leave with the overhead vapor and are routed to the product fractionator while solid coke forms on the inside of the drum. This process continues until the drum is substantially full of hot solid coke.

Once the drum is full, the feed to the coke drum is stopped. Steam is injected into the drum to strip off volatile components such as oil vapors, ammonia and/or hydrogen sulfide which may be present. The overhead vapor produced by steam stripping continues to go to the product fractionator until most of the volatile components (other than steam) have been removed from the coke drum. At this point, the overhead vapor is routed to the coker blowdown system, where it is condensed and may be sent to the refinery sour water system. After injecting steam for a period of time, a quenching water stream is injected into the drum to further cool the hot coke. A portion of the quench water flashes and goes overhead during the quench operation and is captured in the coker blowdown system. Injection of quenching water continues until the drum is cool enough to be opened, typically from about 220° F. (104° C.) to about 150° F. (66° C.).

After the coke drum is opened, any unvaporized quench water is drained from the bottom of the drum and returned to the water storage tank. A hole is then drilled through the center of the solid coke. The coke is removed from the coke drum using a cutting water stream which is injected under high pressure to cut out the solid coke product. The resulting mixture of solid coke and cutting water is then directed to a receiving device such as a tank, pad or conveying system, where a substantial amount of the water is removed from the mixture through evaporation and/or conventional settling processes and is recycled for further use. The solid coke recovered is further processed according to conventional methods to provide a product for commercial use.

Aqueous waste streams produced during the refining of crude oils may be recycled for further use, but are ultimately reintroduced into the environment after conventional treatment to remove contaminants. Generally, this does not create a problem when there is no selenium present in the waste streams or the amount of selenium present is so small that it is of no consequence. In areas where higher concentrations of selenium are naturally present, the aqueous waste streams produced during the refining of the crude oils from these areas may present a problem since these waste streams may exceed the applicable environmental standards. As a result, the selenium levels in these streams must be reduced prior to the streams being reintroduced into the environment.

The process of the present invention is concerned with the situation where the conventional procedures cannot be readily practiced because of the selenium in the aqueous waste streams. Whenever a selenium-containing aqueous stream is used as the quenching water stream in a delayed coking process, according to the present invention, it is possible to effectively extract or remove a substantial amount of the selenium from the selenium-containing aqueous stream and retain the selenium in the final coke product produced, thereby resulting in a coke product of which much of the selenium is an integral part. Typically more than about 85% of the selenium present in the original selenium-containing aqueous stream will be retained in the final coke product either as a part of the actual solid coke or in the residual water. In many instances, more than about 95% of the selenium will be retained in the final coke product. The small amounts of selenium which are not retained in the final coke product remain in the quenching water which is recycled for further use or passed from the coke drum with the overhead gas during quenching. While the selenium-containing aqueous stream is typically a waste stream obtained from within the refining process, any water mixture containing selenium may be utilized as the quenching water stream, provided the mixture does not contain by-products which would undesirably alter the coke product. For instance, the product would be considered undesirably altered if the stream contains compounds which would render the solid coke product inoperable for its intended purpose or would cause the solid coke product to fall outside of the standards set by the Environmental Protection Agency.

The selenium-containing aqueous stream utilized typically contains both insoluble and soluble selenium in its various oxidation states, especially in the non-volatile reduced forms. The selenium-containing aqueous stream to be treated can contain any amount of selenium. Generally, the streams will contain a concentration from about 1 ppm to about 100 ppm selenium, with the typical streams containing from about 10 ppm to about 50 ppm selenium.

After the coking reaction is completed and the coke drum is full of hot solid coke, the drum is taken off-line. Steam is then injected into the coke drum to strip volatile components from the solid coke. The steam and volatile components pass from the drum as an overhead gas. A selenium-containing aqueous stream of the present invention is then injected into the bottom of the coke drum to "quench" the hot coke.

Because of the high temperatures involved, the water present in the selenium-containing aqueous stream is converted into steam as the stream is injected into the coke drum and as the temperature of the coke is reduced. Any remaining volatile components present in the coke are stripped from the solid coke and exit the coke drum with the steam formed as an overhead gas. The majority of the selenium present in the selenium-containing aqueous stream is retained on the surface of the solid coke where it binds in a relatively insoluble form with the coke to produce a solid selenium-coke product. Only a minor amount of the selenium is removed with the steam as an overhead gas.

The selenium-containing aqueous stream is continuously injected into the coke drum until the temperature in the coke drum is cooled to a temperature range from about 150° F. (66° C.) to about 220° F. (104° C.).

Once the hot coke is cooled to the reduced temperature, the drum is opened and any unvaporized quench water is drained and recycled to the water storage tank for further use. The selenium-coke product is then cut from the drum with a highly pressurized cutting water stream. Although in conventional processes the nature of the cutting water, particularly the pH of the cutting water, is not critical, the cutting water stream of the present process is a selenium-containing water stream which has a pH above about 6.5. Preferably, the pH of the cutting water stream is from about 7.0 to about 9.5. Cutting water streams with a pH of less than about 6.5 will cause the selenium-coke bond to break and the selenium to dissolve into the cutting water. Streams with a pH less than about 6.5, especially extremely acidic streams, should have their pH adjusted prior to use.

The cutting water stream utilized will in many instances consist of a selenium-containing aqueous waste stream produced during the refining process, although other sources of water may be utilized. Preferably, the stream will be derived from the same source as the selenium-containing water stream used for quenching, i.e., both the selenium-containing quench water stream and the cutting water stream will be stored in the same water storage tank. The selenium in such cutting water streams does not become an integral part of the selenium-coke product as does the selenium in the quenching stream, but instead remains a part of the cutting water stream.

In an alternative embodiment, the cutting water stream will be derived from a separate source and will either be selenium-free or contain a relatively small amount of selenium, from about 0.2 ppm to about 1 ppm. The stream may also contain other by-products of conventional refining processes provided they do not alter the final coke product in such a way as to cause the product to fall outside of the standards set by the Environmental Protection Agency for solid coke products because some of the cutting water will remain with the selenium-coke product.

Once the selenium-coke product is cut from the coke drum, the mixture is passed to a receiving device where water is separated from the selenium-coke product by evaporation and/or settling techniques. When settling techniques are utilized, the water recovered may be recirculated for further use in the process during the quenching and cutting steps. When the cutting water stream consists of a stream which is selenium-free or contains a relatively small amount of selenium, the stream may be disposed of by reintroducing the stream into the environment after conventional treatment to remove other contaminants. The selenium-coke product is removed from the receiving device and further processed for commercial use.

An additional embodiment of the present invention comprises a process for concentrating the selenium present in stripped sour water streams. A still further embodiment of the present invention comprises concentrating the selenium present in stripped sour water streams and then removing the concentrated selenium from the stripped sour water streams in a delayed coking process by using a portion of the stripped sour water stream as a quenching water stream as described hereinbefore. The stripped sour water streams which contain selenium may optionally be used as a cutting water stream as described hereinbefore.

Considering the application of the process broadly, the process of upgrading various hydrocarbons, including crude oils, to commercial products requires that hydrogen be added and that a part of the sulfur and nitrogen present be removed. This is accomplished by contacting the various hydrocarbon streams with a catalyst in the reactor of a hydroprocessing unit at a temperature from about 500° F. (260° C.) to about 800° F. (427° C.) under a hydrogen atmosphere at a partial pressure from about 100 psia to about 2000 psia (although higher pressures may be used) to convert the sulfur and nitrogen into hydrogen sulfide and ammonia. The hydroprocessing unit may comprise any conventional hydroprocessing equipment including, but not limited to, a catalytic cracking feed hydrotreater, a distillate hydrotreater, a hydroisomerization unit or a hydrocracker unit as well as any combination of two or more of the above. In many instances, a multiple hydroprocessing system comprising two or more hydroprocessing units is utilized.

It is common in hydroprocessing to practice various combinations of cooling, phase separation, water washing and distillation of the reactor effluent. The resulting water stream is generally referred to as a "sour water" stream and contains hydrogen sulfide, ammonia, and other byproducts of refining, such as selenium.

The sour water stream from the hydroprocessing unit is passed to a sour water stripper unit where the stream undergoes stripping to remove substantially all of the ammonia and hydrogen sulfide present. When more than one hydroprocessing unit is used in the refinery, the sour water streams from each of these hydroprocessing units may be combined to form a combined sour water stream which is processed in a sour water stripper unit as described hereinbefore. In an alternative embodiment, sour water streams from one or more hydroprocessing units may be directed to more than one sour water stripper units.

In the sour water stripper unit, steam is used to strip the ammonia and hydrogen sulfide from the sour water stream. The ammonia and hydrogen sulfide are passed from the sour water stripper unit as one or more overhead gas streams which are sent to other parts of the refinery for further processing.

The selenium present in the sour water stream is not stripped but instead remains in the stripped sour water. Typically, stripped sour water streams are withdrawn from the sour water stripper units and either routed for reuse in other processes within the refinery or discharged via refinery water effluent treating facilities. In the present process, the overall selenium content of the sour water is increased as the stripped sour water is recycled through one or more hydroprocessing units and one or more sour water stripper units. This "closed loop" system reduces the overall amount of selenium-containing aqueous waste produced thereby reducing the amount of selenium-containing aqueous waste which will require further treatment to remove the selenium.

The concentrated selenium-containing stripped sour water stream is withdrawn from the bottom of the sour water stripper unit. The amount of selenium present, as well as other contaminants, must be reduced to a level which does not exceed environmental standards before the stream can be reintroduced into the environment. The selenium may be removed utilizing any number of alternative processes which are available. In the preferred embodiment of the present invention the selenium-containing stripped sour water is suitably recycled for further use as reactor effluent wash water in the hydroprocessing unit, after an optional filtration. As the process continues, a minor portion of the selenium-containing stripped sour water is purged from the recycle stream and is passed to a delayed coker unit to be used in the delayed coking process as a quenching water stream and optionally a cutting water stream. The remaining or major portion continues to be recycled. The fraction purged from the recycle stream is preferably equal to or less than the amount needed to carry out the quenching and cutting steps in the delayed coking process although excess amounts which are purged may be stored for future use or directed to other parts of the refinery for further use or treatment for selenium removal. Typically, the selenium-containing stripped sour water purge stream will be withdrawn at a ratio of about 5% to about 50% of the total selenium-containing stripped sour water stream, preferably at a ratio of about 15% of the total selenium-containing stripped sour water stream. An amount of water equivalent to the amount of selenium-containing stripped sour water purged and directed to the delayed coker unit is added to the hydroprocessing unit along with the recycled selenium-containing stripped sour water to balance the system.

The selenium-containing stripped sour water to be used in the delayed coking process is stored in a storage tank for use in the quenching and cutting steps in the delayed coking process. The selenium-containing stripped sour water is first utilized to quench the hot coke and may then be used to cut the selenium-coke product from the coke drum as described hereinbefore.

Those of ordinary skill in the art will recognize that the above process will function in substantially the same manner when multiple hydroprocessing units and multiple sour water stripper units are utilized.

DETAILED DESCRIPTION OF THE DESCRIPTION

FIG. 1 shows portions of a delayed coker unit which may be utilized in the present process of removing selenium from a selenium-containing aqueous stream. Steam is injected via line 6 into an off-line coke drum 1 which is full of hot solid coke to strip the hot coke of volatile components. Volatile components stripped from the hot coke are passed from the coke drum 1 as an overhead gas via line 4. A selenium-containing aqueous stream is passed from a water storage tank 2 via line 3 to the coke drum 1 where the selenium-containing aqueous stream is injected into the bottom of the coke drum 1 to quench the hot coke. The stream is continuously injected into the coke drum 1 until a temperature range from about 150° F. (66° C.) to about 200° F. (104° C.) is reached. Any remaining volatile components are stripped from the hot coke and are passed along with any steam produced from the coke drum 1 as an overhead gas via line 4.

The selenium-coke product thereby formed is then cut from the coke drum 1 utilizing a highly pressurized cutting water stream obtained via line 5 from water storage tank 2. If required, the pH of the cutting water is adjusted by means not shown. Although the cutting water is depicted in FIG. 1 as being stored in the same storage tank 2 as the selenium-containing quench water, the cutting water may be derived from a different source and may be maintained in a separate water storage tank (not shown) from that of the selenium-containing quench water.

The mixture of selenium-coke product and cutting water are passed via line 7 to a receiving device 8 where water is removed from the mixture by evaporation and/or settling techniques. Any water recovered is recycled via line 9 to the water storage tank 2. The selenium-coke product is removed from the receiving device 8 via line 10 and processed for transport.

FIG. 2 depicts the initial step in a particular embodiment of the present invention comprising a process for concentrating the selenium present in stripped sour water streams utilizing a hydroprocessing unit 16 and a sour water stripper unit 26. The concentrated selenium is then removed from the stripped sour water stream by either incorporating the selenium into a selenium-coke product by utilizing a portion of the selenium-containing stripped sour water stream as a quenching water stream and optionally a cutting water stream in a delayed coking process as described hereinbefore or by utilizing alternative processes to remove selenium.

Water is used to wash the hydroprocessing reactor effluent and is subsequently separated from the hydrogen and hydrocarbon products. The resulting water is referred to as "sour water" and contains hydrogen sulfide, ammonia and other by-products of refining such as selenium.

The sour water stream exits the hydroprocessing unit 16 via line 23 and is passed to a sour water stripper unit 26 where the sour water stream undergoes stripping to remove substantially all of the ammonia and hydrogen sulfide present. The sour water stream is introduced into the sour water stripper unit 26 and steam is used to strip the ammonia and hydrogen sulfide from the sour water stream. The hydrogen sulfide and ammonia are passed from the sour water stripper unit 26 in one or more overhead gas streams via line 27 and additional lines (not shown) and are sent to other parts of the refinery for further processing.

The selenium present in the sour water stream remains in the stripped sour water in both soluble and insoluble forms. This selenium-containing stripped sour water stream is withdrawn from the sour water stripper unit 26 via line 28. The portion of the selenium-containing stripped sour water withdrawn, from about 5% to about 50% of the total selenium-containing stripped sour water stream, is passed to the delayed coker unit (not shown) via line 31 where it is stored in a water storage tank (not shown) for future use as a quenching water stream and optionally a cutting water stream in the delayed coking process. The remaining selenium-containing stripped sour water is passed through a filter 32 (which serves to remove solids, including selenium-containing solids) via line 33 and recirculated via line 34 for further use as reactor effluent wash water in the hydroprocessing unit 16. An amount of water equivalent to the amount of selenium-containing stripped sour water removed via line 31 for use in the delayed coking process (from about 5% to about 50% of the total selenium-containing sour water stream) is added to the hydroprocessing unit 16 via line 14 along with the recirculated selenium-containing stripped sour water.

Those of ordinary skill in the art will recognize that the apparatus for conventional delayed coking, the hydroprocessing unit and sour water stripper unit utilized to concentrate selenium in a sour water stream may include additional elements which are not specifically described and/or illustrated in the figures set forth herein in order to simplify the presentation of the claimed invention. Such elements include, but are not limited to, valves, pumps, compressors, condensers and controls. In addition, those of ordinary skill in the art will recognize that an assortment of variations in conventional delayed coking processes may also be employed without changing the scope of the present invention including utilizing multiple coke drums and recirculating the different fluid streams to any variety of steps within the delayed coking process or refining process. In addition, sour water streams may be formed in a variety of systems within the hydroprocessing unit. Such additional elements and variations are known in the art and are intended to be incorporated in the present invention.

The ranges and limitations provided in the instant specification and claims are those which are believed to particularly point out and distinctly claim the instant invention. It is, however, understood that other ranges and limitations that perform substantially the same function in substantially the same way to obtain the same or substantially the same result are intended to be within the scope of the instant invention as defined by the instant specification and claims.

What is claimed is:

1. A process for separating selenium from a selenium-containing aqueous stream utilizing a delayed coking process employing a coker furnace for heating coke feedstock, a coke drum containing hot solid coke, a storage tank for holding quenching water and cutting water, and a receiving device for recovering the resulting solid coke product, which process comprises:

a. injecting the selenium-containing aqueous stream as a quenching water stream into the coke drum containing hot solid coke thereby lowering the temperature in the coke drum to a temperature range from about 150° F. to about 220° F. and forming a solid selenium-coke product in which the selenium is non-water soluble and a substantially selenium-free overhead gas;

b. injecting a pressurized cutting water stream maintained at a pH above about 6.5 into the coke drum thereby breaking up the selenium-coke product; and c. recovering the selenium-coke product from the coke drum.

2. The process of claim 1 wherein the selenium-containing aqueous stream and the cutting water stream are from the same source.

3. The process of claim 2 wherein the cutting water stream is maintained at a pH from about 7.0 to about 9.5.

4. The process of claim 1 wherein the selenium-containing aqueous stream and the cutting water stream are from different sources.

5. The process of claim 4 wherein the cutting water stream is a selenium-free stream maintained at a pH from about 7.0 to about 9.5.

6. A process for removing selenium from selenium-containing sour water streams generated in multiple hydroprocessing units which process selenium-containing feedstocks by contacting said feedstocks at hydroprocessing temperatures with hydrogen, which process comprises:

a. withdrawing from a first hydroprocessing unit a first selenium-containing sour water stream containing ammonia, hydrogen sulfide and selenium;

b. withdrawing from a second hydroprocessing unit a second selenium-containing sour water stream containing ammonia, hydrogen sulfide and selenium;

c. combining the first sour water stream and the second sour water stream to form a combined sour water stream;

d. introducing the combined sour water stream into a sour water stripper unit;

e. recovering from the sour water stripper unit one or more overhead vapor streams containing either ammonia or hydrogen sulfide or both ammonia and hydrogen sulfide and a selenium-containing stripped sour water stream as a bottoms stream;

f. recycling a major portion of the selenium-containing stripped sour water to the first and second hydroprocessing units for further use;

g. directing a minor portion of the selenium-containing stripped sour water to a water storage tank in a delayed coker unit having a coker furnace for heating coke feedstock, a coke drum containing hot solid coke, a storage tank for holding quenching water and cutting water and a receiving device for recovering the resulting solid coke product;

h. injecting the selenium-containing stripped sour water stream into the coke drum containing hot solid coke thereby quenching the temperature in the coke drum to a temperature range from about 150° F. to about 220° F. and forming a solid selenium-coke product in which the selenium is non-water soluble and a substantially selenium-free overhead gas;

i. breaking up the solid selenium-coke product in the coke drum by injecting a pressurized cutting water stream maintained at a pH above about 6.5 into the coke drum; and j. recovering the selenium-coke product from the coke drum in a receiving device.

7. The process of claim 6 wherein the selenium-containing stripped sour water stream and the cutting water stream are from the same source.

8. The process of claim 7 wherein the cutting water stream is maintained at a pH from about 7.0 to about 9.5.

9. The process of claim 8 wherein the minor portion of the selenium-containing stripped sour water is an amount from about 5% to about 50% of the total selenium-containing stripped sour water stream recovered from the sour water stripper unit.

10. The process of claim 6 wherein the selenium-containing stripped sour water stream and the cutting water stream are from different sources.

11. The process of claim 10 wherein the cutting water stream is a selenium-free stream maintained at a pH from about 7.0 to about 9.5.

12. The process of claim 11 wherein the minor portion of the selenium-containing stripped sour water is an amount from about 5% to about 50% of the total selenium-containing stripped sour water stream recovered from the sour water stripper unit.

13. In a delayed coking process comprising introducing a coke feedstock into a coker furnace, heating the coke feedstock to a temperature above about 900° F., passing the heated coke feedstock to a coke drum maintained under conditions allowing for a heated solid coke product to form, injecting a quenching water stream into the coke drum to quench the heated solid coke product, cutting the coke product from the coke drum utilizing a pressurized cutting water stream and recovering the coke product in a receiving device, the improvement which comprises:

a. injecting a selenium-containing aqueous stream as the quenching water stream into the hot solid coke product thereby lowering the temperature in the coke drum to a temperature range from about 150° F. to about 220° F. and forming a solid selenium-coke product in which the selenium is non-water soluble and a substantially selenium free overhead gas;

b. cutting the solid selenium-coke product from the coke drum utilizing a pressurized cutting water stream maintained at a pH above about 6.5.

14. The process of claim 13 wherein the selenium-containing aqueous stream and the cutting water stream are from the same source.

15. The process of claim 14 wherein the cutting water stream is maintained at a pH from about 7.0 to about 9.5.

16. The process of claim 13 wherein the selenium-containing aqueous stream and the cutting water stream are from different sources.

17. The process of claim 16 wherein the cutting water stream is a selenium-free stream maintained at a pH from about 7.0 to about 9.5.

18. A process for removing selenium from a selenium-containing sour water stream generated in a one or more hydroprocessing units which process selenium-containing feedstocks, which process comprises:

a. withdrawing from the one or more hydroprocessing units a selenium-containing sour water steam containing ammonia, hydrogen sulfide and selenium;

b. introducing the sour water stream into a sour water stripper unit;

c. recovering from the sour water stripper unit one or more overhead vapor streams containing either ammonia or hydrogen sulfide or ammonia and hydrogen sulfide and a selenium-containing stripped sour water stream as a bottoms stream;

d. recycling a major portion of the selenium-containing stripped sour water to the hydroprocessing unit for further use;

e. directing a minor portion of the selenium-containing stripped sour water to a storage tank in a delayed coker unit having a coker furnace for heating coke feedstock, a coke drum containing hot solid coke, a storage tank for holding quenching water and cutting water and a receiving device for recovering the resulting solid coke product;

f. injecting the selenium-containing stripped sour water stream into the coke drum containing hot solid coke thereby quenching the temperature in the coke drum to a temperature range from about 150° F. to about 200° F. and forming a selenium-coke product in which the selenium is non-water soluble and a substantially selenium-free overhead gas;

g. injecting a pressurized cutting water stream maintained at a pH above about 6.5 into the coke drum thereby breaking up the solid selenium-coke product; and h. recovering the selenium-coke product from the coke drum.

19. The process of claim 18 wherein the selenium-containing stripped sour water stream and the cutting water stream are from the same source.

20. The process of claim 19 wherein the cutting water stream is maintained at a pH from about 7.0 to about 9.5.

21. The process of claim 20 wherein the minor portion of the selenium-containing stripped sour water is an amount from about 5% to about 50% of the total selenium-containing stripped sour water stream recovered from the sour water stripper unit.

22. The process of claim 18 wherein the selenium-containing stripped sour water stream and the cutting water stream are from different sources.

23. The process of claim 22 wherein the cutting water stream is a selenium-free stream maintained at a pH from about 7.0 to about 9.5.

24. The process of claim 23 wherein the minor portion of the selenium-containing stripped sour water is an amount from about 5% to about 50% of the total selenium-containing stripped sour water stream recovered from the sour water stripper unit.

* * * * *